United States Patent [19]

Kovacs

[11] 4,240,501

[45] Dec. 23, 1980

[54] HEAT EXCHANGER WITH JUXTAPOSED ELEMENTS

[76] Inventor: André L. Kovacs, 177, rue de la Convention, 75015 Paris, France

[21] Appl. No.: 900,476

[22] Filed: Apr. 27, 1978

[30] Foreign Application Priority Data

May 3, 1977 [FR] France ..... 77 13327

[51] Int. Cl.[3] ..... F28F 7/02

[52] U.S. Cl. ..... 165/165; 165/179

[58] Field of Search ..... 165/140, 141, 154, 155, 165/157, 164, 9.2, 9.3, 9.4, 80, 164, 165, 158, 159

[56] References Cited

U.S. PATENT DOCUMENTS

| | | | |
|---|---|---|---|
| 1,983,466 | 12/1934 | Kline | 165/179 |
| 2,442,460 | 6/1948 | Hasche | 165/9.2 |
| 2,821,369 | 1/1958 | Hilliard | 165/159 |
| 3,315,739 | 4/1967 | Kearney | 165/165 |
| 3,727,114 | 4/1973 | Oshima | 165/80 X |
| 4,143,704 | 3/1979 | Kandaker | 165/9.4 |

FOREIGN PATENT DOCUMENTS

| | | | |
|---|---|---|---|
| 197809 | 9/1978 | France | 165/179 |

*Primary Examiner*—Carroll B. Dority, Jr.
*Assistant Examiner*—Theophil W. Streule, Jr.
*Attorney, Agent, or Firm*—Dressler, Goldsmith, Shore, Sutker & Milnamow, Ltd.

[57] ABSTRACT

The invention relates to a heat exchanger, constituted by a plurality of superposed units, each unit being constituted by a cylinder provided with outer fins and inner fins. The tightening of the units on one another effects a seal between a space inside the units and an outer space. Fluids circulate respectively inside and outside. The units are of sufficiently short dimension to allow an easy shaping of ribs and particularly of inner ribs. The invention is more particularly applied to the exchange of heat between two gaseous fluids.

9 Claims, 2 Drawing Figures

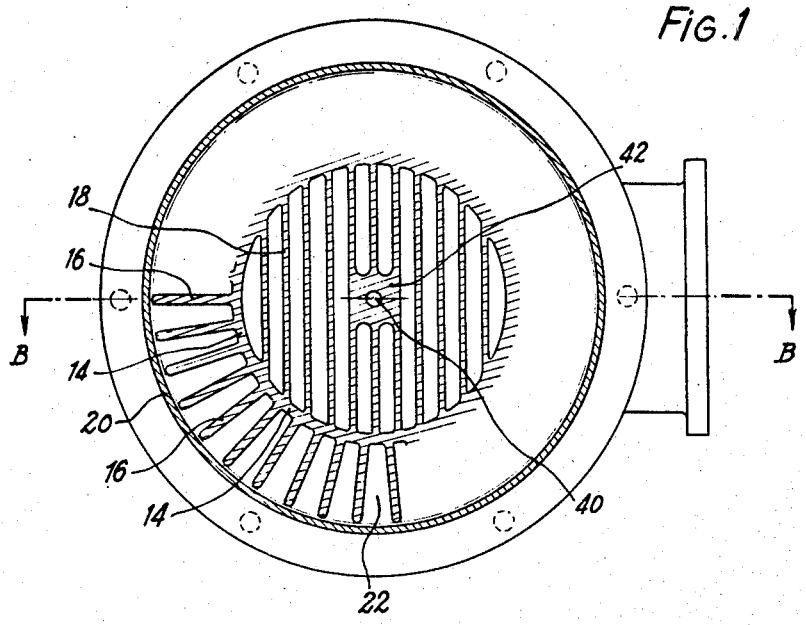
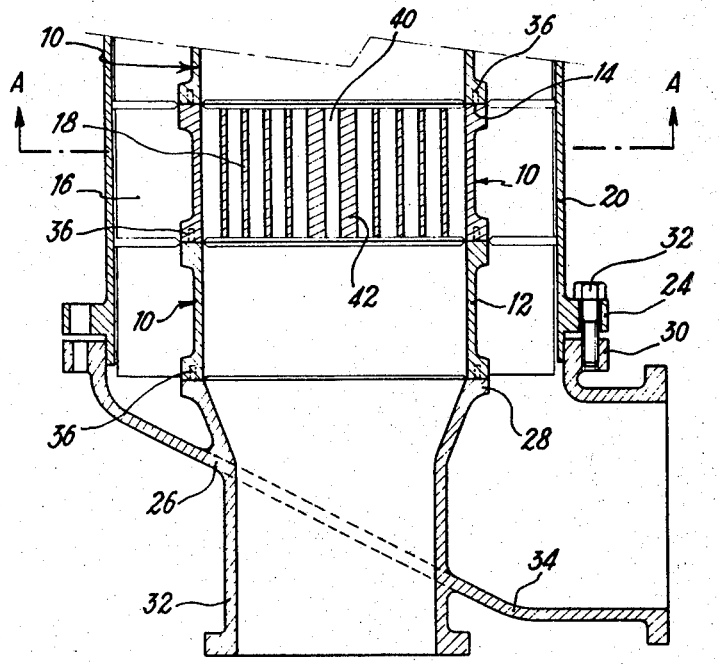
FIG. 2

HEAT EXCHANGER WITH JUXTAPOSED ELEMENTS

The present invention relates to heat exchangers, and more particularly to those intended to effect a heat transfer between two fluids having poor coefficients of convection, as is the case for example for gases (air or the like).

In this case, it is necessary to produce exchangers having wide surfaces of separation between the fluids, and it is usual to provide the outer walls of exchangers with radial fins.

However, this arrangement is of interest only if the fluid circulating inside the separation wall has a good coefficient of convection. In fact, in the contrary case, and particularly if it is a gas at low pressure, the exchange by convection with a smooth inner wall is very low and the outer fins are hardly of interest.

To remedy this drawback, the present invention proposes an exchanger of which both outer and inner walls are provided with fins; however, as such inner fins are difficult to produce on an exchanger of a certain length, it is here proposed to produce an exchanger constituted by a plurality of cylindrical units of short axial dimensions, superposed contiguously, these units comprising on the one hand other fins distributed over the outer periphery of the wall of the units and on the other hand inner fins distributed over the inner periphery of the units.

The short dimension of the units, which are then juxtaposed contiguously, allows the construction of the inner fins which would otherwise be very difficult to produce if a whole exchanger had to be constructed in one piece.

The fins of the units of short dimension may be formed by moulding, or machining by removal of material or even by assembling or welding the fins on a cylindrical body.

The inner fins may be constituted by ribs completely partitioning the space inside the cylindrical units.

The outer ribs are preferably radial.

As the fluids circulate in the axial direction of the exchanger composed of superposed units and as the heat exchange is effected by contact of the fluids on the inner and outer fins, it is advantageously provided to superpose the units so that the fins are not superposed but so that, on the contrary, a given fin is crosswise with respect to other fins or comes above a gap between two fins.

For example, if fins extend radially with respect to the axis of a circular cylindrical unit, the units are superposed so that the fins of one come above the gaps between the fins of the other. If the inner fins are ribs which are parallel to one another, the units may be superposed so that the ribs of one intersect, at a certain angle (which may be a right angle to facilitate positioning), the ribs of the adjacent units.

An advantageous embodiment of the exchanger according to the invention consists in providing on each cylindrical unit outer fins which are radial and inner ribs which are parallel to one another.

The cylinders are enclosed in an envelope which ensures their centering and which defines a conduit for circulation of fluid outside the cylindrical walls of the superposed units.

The invention will be more readily understood on reading the following description with reference to the accompanying drawings, in which:

FIG. 1 shows a section in plan view through a heat exchanger according to the invention, FIG. 2 shows a longitudinal section through the exchanger.

Referring now to the drawings, this exchanger is essentially constituted by a plurality of cylindrical units 10, preferably of circular cross-section, which are superposed on one another.

These units present a continuous outer cylindrical wall 12 so as to delimit inner and outer spaces separated from one another for the respective circulation of a first and a second fluid. The units are superposed contiguously by the circular edges 14 of their walls 12. The tightness is produced by the tightening of the units on one another as will be seen hereinafter and possibly by supplementary means such as seals. The units may even be welded, brazed or glued to one another.

Each cylindrical unit 10 is provided with fins 16 made on its outer periphery, which fins increase the heat exchange surface between the unit and the fluid circulating in the space outside the unit.

In the example shown, the outer fins 16 are constituted by plates extending radially and parallel to the axis of the cylindrical units over virtually the whole height thereof.

Moreover, inner fins 18 are arranged on the inner periphery of the cylindrical units 10 to increase the heat exchange between these units and the fluid circulating in the space inside the unit.

In the example shown, the inner fins 18 are constituted by parallel ribs partitioning the space inside the unit. These ribs, like the outer fins, are constituted by plates extending virtually over the whole height of the units.

The superposed cylindrical units 10 are placed inside a cylindrical envelope 20 which tightens them laterally, defining between the outer wall of the units 10 and the inner wall of this envelope a closed space 22 in which a fluid may circulate. This space is partitioned by the outer fins 16 of the units. For certain applications, such an envelope may be unnecessary if, for example, one of the fluids with which it is desired to exchange heat is the outside air.

The envelope comprises at its ends flanges 24 or other assembly means for its connection to bottom members such a 26 whose shape is adapted to allow the connection of the space inside the units to a conduit 32 for supplying a first fluid and the space outside the units (space 22) to a conduit 34 for supplying a second fluid.

Part of the bottom member 26 therefore comprises a shoulder 28 with a flat annular surface adapted tightly to receive the base of the cylindrical wall of an end unit of the assembly of juxtaposed units.

The bottom member 26 comprises on the other hand means such as a flange 30 to be tightly fixed to the envelope 20.

A bottom member similar to bottom member 26 may be fixed to the other end of the stack of juxtaposed units.

The tightening of the envelope containing the superposed units on one bottom then on the other effects the tightening of the cylindrical units 10 on one another, the tightness being effected at the level of the circular surfaces 14 in contact with one another at the ends of the walls 12 of the units.

The units 10 are preferably superposed so that the outer and inner fins are not superposed on one another, in order to increase the number of leading edges encountered by the fluids in their path along the stack of units, in order thus to improve the coefficient of heat exchange between the fluids. The units are then arranged to be superposed so that the outer radial fins 16 of one come opposite gaps between outer fins of the adjacent units.

The parallel ribs of the embodiment described more precisely here are also arranged so as not to be superposed but on the contrary pass in different directions.

To facilitate superposition of the units whilst respecting these constraints, positioning means such as fingers 36 may be provided on an end surface 14 of the wall 12 of each unit, these fingers cooperating with reinforcements made at corresponding spots on the other end surface of the adjacent units, so as to effect positioning by interlocking of the end surfaces in each other.

Other positioning means (notches, catches, pins, etc . . . ) may obviously be provided.

By way of example, four fingers 36 may be provided, positioned at 90° with respect to one another, so as to be able to superpose the units alternately with 90° orientations with respect to one another (i.e. the ribs 18 of one perpendicular to the ribs of the adjacent units). If the number of regularly distributed outer fins 16 is even but not a multiple of four, this 90° superposition will result in the outer fins of the adjacent units not being superposed, this being the desired end. This end is thus attained with a considerable ease of positioning.

To improve the tightening of the units 10 on one another and the seal between the inside and the outside of the units, a rod may be provided, extending over the whole length of the superposed units and passing therethrough through a central opening 40 made in a solid central portion 42 of each of the units. This central portion is left between ribs 18 inside the unit and is fast with the wall 12 of the unit by the ribs. The rod is bolted on the outer surfaces of the end units of the stack to tighten the units on one another. It has the advantage of ensuring an efficient centering of the units with respect to one another by imposing an alignment of the central openings 40 of all the units.

The units are of sufficiently short height to be able to be shaped easily by conventional methods, including the fins, ribs and possibly centering fingers and centering openings.

The units may be shaped by machining, casting, welding fins on a cylindrical wall, or assembly by other means.

It is possible thus to produce fairly long exchangers, whilst having the possibility of forming a large number of inner and outer fins.

What is claimed is:

1. A heat exchanger which comprises a plurality of hollow cylindrical units, superposed contiguously on a common axis, said units having outer fins distributed on the outer periphery thereof and inner fins on the inner periphery thereof, said outer and inner fins extending outwardly and inwardly, respectively from said periphery in planes parallel to the direction of superposition of the cylindrical units and parallel to said common axis, the interior space defined by each of said hollow cylindrical units providing a first channel for circulation of a fluid along the longitudinal axis of the cylinders, and an envelope in which said cylindrical units are positioned, the inner wall of said envelope defining, with the outer wall of the superposed cylinders, a second channel for the circulation of a fluid along said axis.

2. The heat exchanger of claim 9, wherein the inner fins of each of said cylindrical units are constituted by ribs forming partitions in the space inside the cylinder.

3. The heat exchanger of claim 1, wherein at least some of said fins of any given cylinder are positioned entirely above gaps between fins of the cylinders immediately adjacent to it, in order to provide a number of leading edges of said fins to be encountered by the fluids in their flow in the direction of the longitudinal axis of the cylinders.

4. The heat exchanger of claim 1 wherein positioning means is provided on the end surface of the wall of each of said units, said positioning means being spaced 90° from one another, wherein the outer fins are radial and even in number but not a multiple of four, and wherein the inner fins are parallel ribs and the units are superposed so that the inner ribs of one are perpendicular to the inner ribs of the adjacent units.

5. The heat exchanger of claim 4, wherein said inner parallel ribs intersect, at a certain angle, the inner parallel ribs of the immediately adjacent cylinders.

6. The heat exchanger of claim 1, wherein at least some of the inner fins of a given cylindrical unit are ribs connecting opposite portions of the wall of said unit and positioning means is provided on the end surface of the wall of each of said units, and wherein said cylindrical units are tightened by a rod passing through all of said units through their centers in aligned openings formed in a solid central portion connected to the walls by the ribs.

7. The heat exchanger of claim 2, wherein said parallel partitions define a plurality of discrete passages for flow of fluid therethrough.

8. The heat exchanger of claim 1 wherein all the fins of any given cylinder are positioned at least in part opposite gaps between fins of the immediately adjacent cylinders, with at most one half the area of the end wall of each of the fins of said given cylinder being superposed above the end wall of the fin of each cylinder immediately adjacent to it, in order to provide a major area of each of the leading edges of said fins to be encountered by the fluids in their flow in the direction of the longitudinal axis of the cylinders.

9. The heat exchanger of claim 8 wherein all the fins of said given cylinder are positioned entirely above gaps between fins of said immediately adjacent cylinder, in order to provide the maximum number of leading edges of said fins to be encountered by the fluids in their flow in the direction of the longitudinal axis of the cylinders.

* * * * *